US010599083B2

(12) United States Patent
Yoshida

(10) Patent No.: US 10,599,083 B2
(45) Date of Patent: Mar. 24, 2020

(54) IMAGE FORMING APPARATUS

(71) Applicant: KONICA MINOLTA, INC., Chiyoda-ku, Tokyo (JP)

(72) Inventor: Tomohisa Yoshida, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/388,273

(22) Filed: Apr. 18, 2019

(65) Prior Publication Data

US 2019/0354052 A1 Nov. 21, 2019

(30) Foreign Application Priority Data

May 16, 2018 (JP) ..... 2018-094355

(51) Int. Cl.
*G03G 15/00* (2006.01)
*G03G 21/00* (2006.01)

(52) U.S. Cl.
CPC ..... *G03G 15/5062* (2013.01); *G03G 21/0005* (2013.01)

(58) Field of Classification Search
CPC ..... G03G 15/5008; G03G 2215/00734–00751
See application file for complete search history.

(56) References Cited

U.S. PATENT DOCUMENTS

2011/0142461 A1* 6/2011 Nakamura ..... G03G 15/5029 399/45
2013/0039672 A1* 2/2013 Ishida ..... G03G 15/5029 399/45
2016/0139550 A1* 5/2016 Ishida ..... G03G 15/5029 399/45
2017/0038710 A1* 2/2017 Tamura ..... G03G 15/5029
2017/0336748 A1* 11/2017 Maejima ..... G03G 15/6514
2017/0344842 A1* 11/2017 Perez Munoz ..... B41J 15/046
2019/0171149 A1* 6/2019 Tsujimoto ..... G03G 15/5029

FOREIGN PATENT DOCUMENTS

JP 2007055814 A 3/2007

* cited by examiner

*Primary Examiner* — Sevan A Aydin
(74) *Attorney, Agent, or Firm* — Buchanan Ingersoll & Rooney PC

(57) ABSTRACT

An image forming apparatus includes: a printing part including: an image carrier on a surface of which an electrostatic latent image is to be formed; a developing device that develops the electrostatic latent image to generate a toner image; a transfer device that transfers the toner image to a paper sheet; a fixing device that fixes the toner image; and a cleaner that removes toner remaining on the image carrier; a selection part that allows a user to select one of a plurality of automatic detection modes; a paper conveying part including: a paper feeder that supplies the paper sheet; a conveying roller that conveys the paper sheet; and a timing roller that supplies the paper sheet to a transfer position; a detector that detects a characteristic of the paper sheet; and a hardware processor that detects a paper type category, and controls the printing part under image forming conditions.

17 Claims, 12 Drawing Sheets

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 90 | | 165°C | 1800V |
| THICK PAPER 1 | 91 TO 120 | 100mm/s | 140°C | 1300V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

| NAME | BASIS WEIGHT [g/m²] | PROCESSING SPEED | FIXING TEMPERATURE | TRANSFER VOLTAGE |
|---|---|---|---|---|
| THIN PAPER | 51 TO 55 | 200mm/s | 140°C | 1450V |
| | 56 TO 60 | | 145°C | 1550V |
| PLAIN PAPER | 61 TO 75 | | 160°C | 1750V |
| | 76 TO 90 | | 165°C | 1850V |
| THICK PAPER 1 | 91 TO 105 | 100mm/s | 135°C | 1200V |
| | 106 TO 120 | | 140°C | 1400V |
| THICK PAPER 2 | 121 TO 140 | | 145°C | 1500V |
| | 141 TO 160 | | 150°C | 1700V |
| THICK PAPER 3 | 161 TO 180 | | 153°C | 1800V |
| | 181 TO 210 | | 155°C | 2000V |
| THICK PAPER 4 | 211 TO 230 | | 158°C | 2100V |
| | 231 TO 260 | | 160°C | 2300V |
| THICK PAPER 5 | 261 TO 280 | | 165°C | 2400V |
| | 281 TO 300 | | 170°C | 2600V |

FIG. 5A

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 90 | | 165°C | 1800V |
| THICK PAPER 1 | 91 TO 120 | 100mm/s | 140°C | 1300V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

FIG. 5B

| NAME | BASIS WEIGHT [g/m²] | PROCESSING SPEED | FIXING TEMPERATURE | TRANSFER VOLTAGE |
|---|---|---|---|---|
| THIN PAPER | 51 TO 55 | 200mm/s | 140°C | 1450V |
| | 56 TO 60 | | 145°C | 1550V |
| PLAIN PAPER | 61 TO 75 | | 160°C | 1750V |
| | 76 TO 90 | | 165°C | 1850V |
| THICK PAPER 1 | 91 TO 105 | 100mm/s | 135°C | 1200V |
| | 106 TO 120 | | 140°C | 1400V |
| THICK PAPER 2 | 121 TO 140 | | 145°C | 1500V |
| | 141 TO 160 | | 150°C | 1700V |
| THICK PAPER 3 | 161 TO 180 | | 153°C | 1800V |
| | 181 TO 210 | | 155°C | 2000V |
| THICK PAPER 4 | 211 TO 230 | | 158°C | 2100V |
| | 231 TO 260 | | 160°C | 2300V |
| THICK PAPER 5 | 261 TO 280 | | 165°C | 2400V |
| | 281 TO 300 | | 170°C | 2600V |

FIG. 6A

| | SETTING | | |
|---|---|---|---|
| PAPER FEEDER 1 | MANUAL | AUTOMATIC 1 | AUTOMATIC 2 |
| PAPER FEEDER 2 | MANUAL | AUTOMATIC 1 | AUTOMATIC 2 |
| PAPER FEEDER 3 | MANUAL | AUTOMATIC 1 | AUTOMATIC 2 |
| PAPER FEEDER 4 | MANUAL | AUTOMATIC 1 | AUTOMATIC 2 |

FIG. 6B

| PAPER TYPE |
|---|
| LOADED WITH PLAIN PAPER (61 TO 90 g/m$^2$) |
| LOADED WITH THICK PAPER 1 (91 TO 120 g/m$^2$) |
| LOADED WITH PLAIN PAPER (61 TO 90 g/m$^2$) |
| LOADED WITH PLAIN PAPER (61 TO 90 g/m$^2$) |

FIG. 7A

| | SETTING | | |
|---|---|---|---|
| PAPER FEEDER 1 | MANUAL | AUTOMATIC 1 | AUTOMATIC 2 |
| PAPER FEEDER 2 | MANUAL | AUTOMATIC 1 | AUTOMATIC 2 |
| PAPER FEEDER 3 | MANUAL | AUTOMATIC 1 | AUTOMATIC 2 |
| PAPER FEEDER 4 | MANUAL | AUTOMATIC 1 | AUTOMATIC 2 |

FIG. 7B

| PAPER TYPE |
|---|
| AUTOMATIC DETECTION TO BE PERFORMED IN HIGH-PRECISION MODE |
| AUTOMATIC DETECTION TO BE PERFORMED IN HIGH-SPEED MODE |
| LOADED WITH PLAIN PAPER (61 TO 90 g/m$^2$) |
| LOADED WITH PLAIN PAPER (61 TO 90 g/m$^2$) |

FIG. 8A

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 90 | | 165°C | 1800V |
| THICK PAPER 1 | 91 TO 120 | 100mm/s | 140°C | 1300V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

FIG. 8B

| NAME | BASIS WEIGHT [g/m²] | PROCESSING SPEED | FIXING TEMPERATURE | TRANSFER VOLTAGE |
|---|---|---|---|---|
| THIN PAPER | 51 TO 55 | 200mm/s | 140°C | 1450V |
| | 56 TO 65 | | 145°C | 1550V |
| PLAIN PAPER | 66 TO 85 | | 160°C | 1750V |
| | 86 TO 95 | | 165°C | 1850V |
| THICK PAPER 1 | 96 TO 115 | 100mm/s | 135°C | 1200V |
| | 116 TO 125 | | 140°C | 1400V |
| THICK PAPER 2 | 126 TO 155 | | 145°C | 1500V |
| | 155 TO 165 | | 150°C | 1700V |
| THICK PAPER 3 | 166 TO 205 | | 153°C | 1800V |
| | 206 TO 215 | | 155°C | 2000V |
| THICK PAPER 4 | 216 TO 255 | | 158°C | 2100V |
| | 256 TO 265 | | 160°C | 2300V |
| THICK PAPER 5 | 266 TO 285 | | 165°C | 2400V |
| | 285 TO 305 | | 170°C | 2600V |

FIG. 9A

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 90 | | 165°C | 1800V |
| THICK PAPER 1 | 91 TO 120 | 100mm/s | 140°C | 1300V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

FIG. 9B

| NAME | BASIS WEIGHT [g/m²] | PROCESSING SPEED | FIXING TEMPERATURE | TRANSFER VOLTAGE |
|---|---|---|---|---|
| THIN PAPER | 51 TO 55 | 200mm/s | 140°C | 1450V |
| | 56 TO 60 | | 145°C | 1550V |
| PLAIN PAPER | 61 TO 75 | | 160°C | 1750V |
| | 76 TO 90 | | 165°C | 1850V |
| THICK PAPER 1 | 91 TO 105 | 100mm/s | 135°C | 1200V |
| | 106 TO 120 | | 140°C | 1400V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

FIG. 10

TABLE Ts FOR HIGH-PRECISION DETECTION MODE

| NAME | BASIS WEIGHT [g/m²] | PROCESSING SPEED | FIXING TEMPERATURE | TRANSFER VOLTAGE |
|---|---|---|---|---|
| THIN PAPER | 51 TO 55 | 200mm/s | 140°C | 1450V |
| | 56 TO 60 | | 145°C | 1550V |
| PLAIN PAPER | 61 TO 75 | | 160°C | 1750V |
| | 76 TO 90 | | 165°C | 1850V |
| THICK PAPER 1 | 91 TO 105 | 100mm/s | 135°C | 1200V |
| | 106 TO 120 | | 140°C | 1400V |
| THICK PAPER 2 | 121 TO 140 | | 145°C | 1500V |
| | 141 TO 160 | | 150°C | 1700V |
| THICK PAPER 3 | 161 TO 180 | | 153°C | 1800V |
| | 181 TO 210 | | 155°C | 2000V |
| THICK PAPER 4 | 211 TO 230 | | 158°C | 2100V |
| | 231 TO 260 | | 160°C | 2300V |
| THICK PAPER 5 | 261 TO 280 | | 165°C | 2400V |
| | 281 TO 300 | | 170°C | 2600V |

| FREQUENCY OF USE BY USER | | |
|---|---|---|
| | | HIGH |
| 50% | 70% | 90% OR MORE |
| 50% | 30% | 10% OR LESS |

FIG. 11A

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 90 | | 165°C | 1800V |
| THICK PAPER 1 | 91 TO 120 | 100mm/s | 140°C | 1300V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

FIG. 11B

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 90 | | 160°C | 1750V |
| THICK PAPER 1 | 91 TO 120 | 100mm/s | 140°C | 1300V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

FIG. 12A

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 95 | | 165°C | 1800V |
| THICK PAPER A | 96 TO 160 | 100mm/s | 145°C | 1600V |
| THICK PAPER B | 161 TO 230 | | 155°C | 2000V |
| THICK PAPER C | 231 TO 300 | | 165°C | 2400V |

FIG. 12B

| NAME | BASIS WEIGHT [g/m²] | PROCESSING SPEED | FIXING TEMPERATURE | TRANSFER VOLTAGE |
|---|---|---|---|---|
| THIN PAPER | 51 TO 60 | 200mm/s | 145°C | 1500V |
| PLAIN PAPER | 61 TO 90 | | 165°C | 1800V |
| THICK PAPER 1 | 91 TO 120 | 100mm/s | 140°C | 1300V |
| THICK PAPER 2 | 121 TO 160 | | 150°C | 1600V |
| THICK PAPER 3 | 161 TO 210 | | 155°C | 1900V |
| THICK PAPER 4 | 211 TO 260 | | 160°C | 2200V |
| THICK PAPER 5 | 261 TO 300 | | 170°C | 2500V |

IMAGE FORMING APPARATUS

The entire disclosure of Japanese patent Application No. 2018-094355, filed on May 16, 2018, is incorporated herein by reference in its entirety.

BACKGROUND

Technological Field

The present invention relates to an image forming apparatus, and more particularly to an electrophotographic image forming apparatus with an automatic detection mode for automatically detecting the type of paper.

Description of the Related Art

In an electrophotographic image forming apparatus, a surface of an image carrier including a photoconductive material is uniformly charged by a charging means and exposed by an exposure means. Thus, a potential difference is generated on the surface of the image carrier to form an electrostatic latent image. Then, the electrostatic latent image is developed by a developing device to form a toner image. The toner image is transferred to a paper sheet, and fixed on the paper sheet by use of heat, pressure, and the like.

In such an image forming apparatus, there is a possibility that many types of paper sheet may be used. Each paper sheet has various characteristics such as a basis weight, size, transparency, gloss, rigidity, smoothness, and the like. In order to achieve high image quality, it is necessary to set, for each paper sheet, optimum image forming conditions (processing speed, developing condition, transfer condition, fixing condition, and image processing condition) to form an image.

Some of conventional image forming apparatuses form an image under optimum image forming conditions corresponding to the type of paper (hereinafter referred to as a paper type) set by a user when the user sets the paper type by using an operation panel, an information terminal, or the like. However, such image forming apparatuses have a problem in that an image defect, fixing failure, or a paper jam occurs if a user forgets to set or erroneously sets a paper type.

As a countermeasure against this, there is a method for detecting characteristics of a paper sheet, such as thickness, transparency, and smoothness, with a detector provided, and for automatically determining a paper type based on the results of detection. For example, JP 2007-55814 A discloses a technique of taking an image of the surface of a paper sheet with a complementary metal-oxide semiconductor (CMOS) sensor, determining a paper type based on the result of taking the image, and setting image forming conditions based on the paper type. In addition, there is also a technique of detecting the amount of light transmitted through a paper sheet, and automatically determining a paper type based on the result of detection.

Furthermore, it is necessary to reduce the number of detectors for detecting characteristics of a paper sheet, due to a recent demand for cost reduction and miniaturization of an apparatus. As a countermeasure against this, there is a technique of providing, on a paper conveyance path, a detector to be used in common by a plurality of paper feeders. According to the technique, characteristics of paper sheets cannot be detected at the time of loading the paper sheets into the paper feeder. Instead, the characteristics of the paper sheets are detected in the process of conveying each of the paper sheets to a timing roller. Therefore, a single detector just needs to be provided, regardless of the number of paper feeders. Thus, it is possible to achieve cost reduction and miniaturization of an apparatus.

In the above-described technique with a single detector provided on the paper conveyance path, a paper type is detected after a paper sheet is conveyed to the detector or while the paper sheet is conveyed. In the technique, an increase in the speed of conveying a paper sheet increases the fluttering of the paper sheet, and reduces time required for the paper sheet to pass through the detector. Thus, while detection speed increases, accuracy in detection decreases.

In contrast, a reduction in the speed of conveying a paper sheet reduces the fluttering of the paper sheet, and increases time required for the paper sheet to pass through the detector. Thus, while accuracy in detection increases, longer time is required for detection, resulting in a decline in image productivity. Therefore, it is preferable to allow a user to select the speed of detecting a paper type in consideration of a balance between accuracy in detection of the paper type and productivity of an image.

SUMMARY

Therefore, a main object of the present invention is to provide an image forming apparatus capable of allowing a user to select the speed of detecting a paper type, and forming a satisfactory image according to a paper type.

To achieve the abovementioned object, according to an aspect of the present invention, an image forming apparatus reflecting one aspect of the present invention comprises: a printing part including: an image carrier on a surface of which an electrostatic latent image is to be formed; a developing device that develops the electrostatic latent image to generate a toner image; a transfer device that transfers the toner image on the image carrier to a paper sheet at a transfer position; a fixing device that fixes the toner image transferred by the transfer device, on the paper sheet; and a cleaner that removes toner remaining on the image carrier; a selection part that allows a user to select one of a plurality of automatic detection modes of different detection speeds; a paper conveying part including: a paper feeder that supplies the paper sheet; a conveying roller that conveys the paper sheet supplied from the paper feeder at a conveyance speed corresponding to a detection speed in the automatic detection mode selected with the selection part; and a timing roller that supplies the paper sheet conveyed by the conveying roller, to the transfer position; a detector that detects a characteristic of the paper sheet being conveyed by the conveying roller; and a hardware processor that detects a paper type category to which the paper sheet belongs based on the automatic detection mode selected with the selection part and a result of detection by the detector, and controls the printing part under image forming conditions corresponding to the detected paper type category, to print the toner image on the paper sheet.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGS. 5A and 5B are diagrams showing tables stored in a storage part shown in FIG. 4;

FIGS. 6A and 6B are diagrams showing images to be displayed on an operation panel shown in FIG. 4;

FIGS. 7A and 7B are diagrams showing other images to be displayed on the operation panel shown in FIG. 4;

FIGS. 8A and 8B are diagrams showing tables to be used in an image forming apparatus according to a second embodiment of the present invention;

FIGS. 9A and 9B are diagrams showing tables to be used in an image forming apparatus according to a third embodiment of the present invention;

FIG. 10 is a diagram for describing operation of an image forming apparatus according to a fourth embodiment of the present invention;

FIGS. 11A and 11B are other diagrams for describing operation of the image forming apparatus described in FIG. 10; and FIGS. 12A and 12B are diagrams showing some of tables to be used in an image forming apparatus according to a fifth embodiment of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
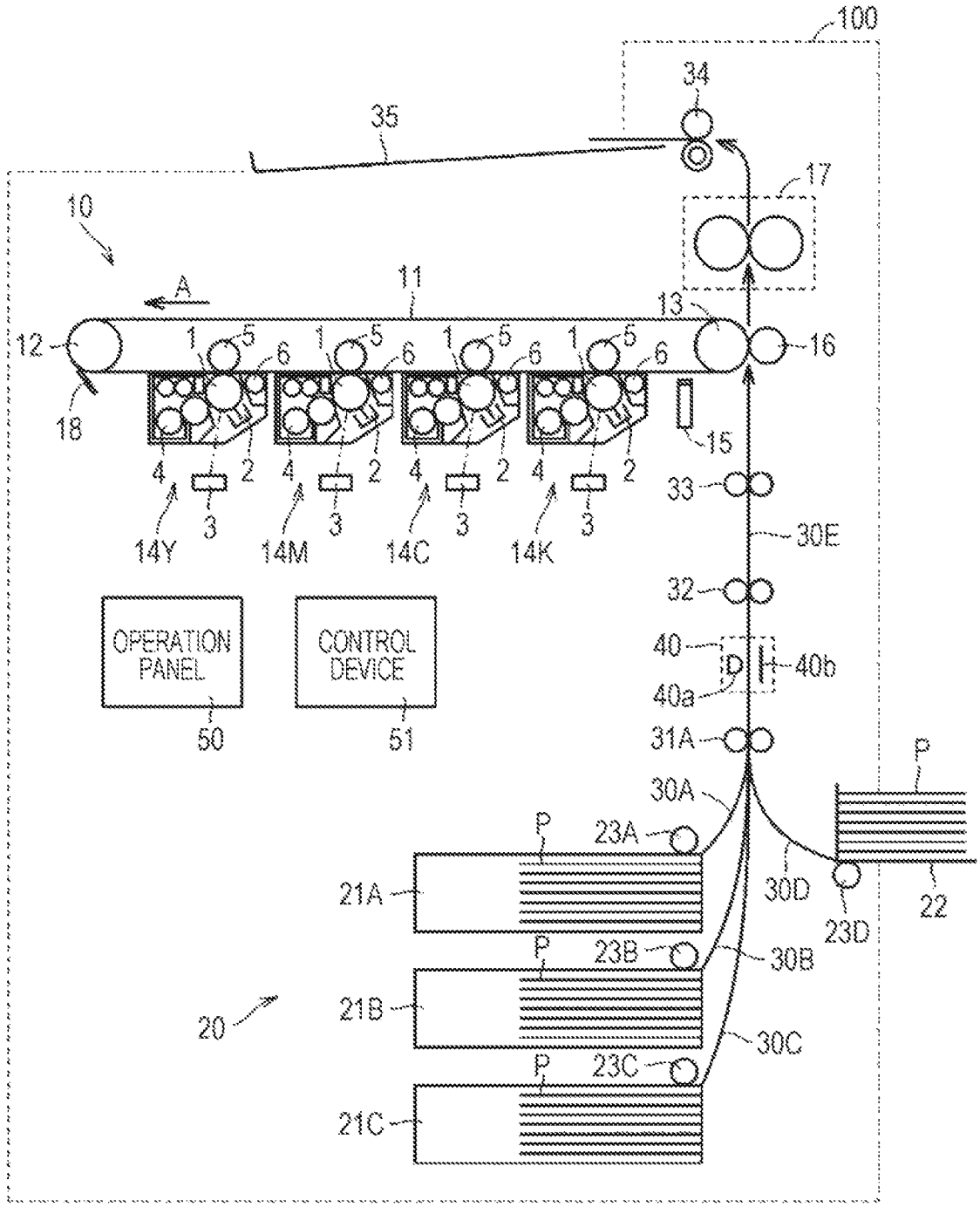
FIG. 1 is a diagram showing a configuration of an image forming apparatus according to a first embodiment of the present invention.

FIG. 1 is a diagram showing a configuration of an image forming apparatus 100 according to a first embodiment of the present invention. In FIG. 1, the image forming apparatus 100 is a so-called tandem-type color printer, which prints a full-color toner image on a paper sheet P by electrophotography. The image forming apparatus 100 includes a printing part 10, a paper conveying part 20, an operation panel 50, and a control device 51.

The printing part 10 includes an intermediate transfer belt 11, a driving roller 12, a driven roller 13, imaging units 14Y 14M, 14C, and 14K, a toner concentration sensor 15, a secondary transfer roller 16, a fixing device 17, and a cleaner 18.

The intermediate transfer belt 11 is formed as an endless belt, and is stretched, in the horizontal direction in the drawing, by the driving roller 12 and the driven roller 13. As the driving roller 12 is rotationally driven by a motor (not shown), the intermediate transfer belt 11 is rotationally driven in the direction of an arrow A (counterclockwise direction) in the drawing.

The imaging units 14Y, 14M, 14C, and 14K are sequentially arranged along the lower surface of the intermediate transfer belt 11 in the direction of rotation of the intermediate transfer belt 11. The imaging units 14Y, 14M, 14C, and 14K generate toner images in yellow (Y), magenta (M), cyan (C), and black (K), respectively.

Each of the imaging units 14Y, 14M, 14C, and 14K includes a photosensitive drum 1 (image carrier), a charger 2, an exposure part 3, a developing device 4, a primary transfer roller 5, and a cleaner 6. The surface of the photosensitive drum 1 is in contact with the surface of the intermediate transfer belt 11. The photosensitive drum 1 and the intermediate transfer belt 11 rotate in the same direction at a portion at which the photosensitive drum 1 and the intermediate transfer belt 11 are in contact with each other. The charger 2, the exposure part 3, the developing device 4, the primary transfer roller 5, and the cleaner 6 are sequentially arranged along the surface of the photosensitive drum 1 in the direction of rotation of the photosensitive drum 1. The charger 2 uniformly charges the surface of the photosensitive drum 1.

The exposure part 3 includes, for example, a laser diode that emits a laser beam, and a polygon mirror that scans the surface of the photosensitive drum 1 with a laser beam. The exposure part 3 irradiates the surface of the photosensitive drum 1 with a laser beam in accordance with image information to expose the photosensitive drum 1. There is generated a potential difference between a portion irradiated with the laser beam and the other portion. Thus, an electrostatic latent image is formed on the surface of the photosensitive drum 1.

The developing device 4 develops the electrostatic latent image formed on the surface of the photosensitive drum 1 with toner to generate a toner image on the surface of the photosensitive drum 1. The developing device 4 develops the electrostatic latent image by using, for example, a two-component developer including toner and a carrier. Note that it is also possible to use a one-component developer (toner) for development.

The primary transfer roller 5 is provided on the back side of the intermediate transfer belt 11 and pressed against the photosensitive drum 1 via the intermediate transfer belt 11. When a primary transfer bias voltage having a polarity opposite to that of the toner is applied to the primary transfer roller 5, the toner image on the surface of the photosensitive drum 1 is transferred to the surface of the intermediate transfer belt 11. The cleaner 6 removes toner remaining on the surface of the photosensitive drum 1 after the transfer to the intermediate transfer belt 11.

Toner images are formed in four colors on the four photosensitive drums 1 of the imaging units 14C, 14M, 14Y, and 14K. The toner images formed in four colors on the four photosensitive drums 1 are sequentially transferred to the surface of the intermediate transfer belt 11, and superimposed thereon to form a full-color toner image.

The toner concentration sensor 15, the secondary transfer roller 16, and the cleaner 18 are provided downstream of the imaging unit 14K in the direction of rotation of the intermediate transfer belt 11. The toner concentration sensor 15 detects the density of the toner image on the surface of the intermediate transfer belt 11, and outputs a signal indicating a detection value. Based on the output signal from the toner concentration sensor 15, the control device 51 controls a developing bias voltage and the like so as to achieve a predetermined toner concentration.

The secondary transfer roller 16 is pressed against the driven roller 13 via the intermediate transfer belt 11. When a secondary transfer bias voltage having a polarity opposite to that of the toner is applied to the secondary transfer roller 16 during a period in which the paper sheet P is inserted in a nip between the secondary transfer roller 16 and the intermediate transfer belt 11, the toner image on the surface of the intermediate transfer belt 11 is transferred to the paper sheet P. The fixing device 17 applies pressure and heat to fix the toner image on the paper sheet P. The cleaner 18 removes toner remaining on the surface of the intermediate transfer belt 11 after the transfer to the paper sheet P.

The paper conveying part 20 includes a plurality of (three in FIG. 1) paper feed cassettes 21A to 21C, a paper feed tray 22, paper feed rollers 23A to 23D, conveyance paths 30A to 30E, conveying rollers 31A and 32, timing rollers 33, paper discharge rollers 34, and a paper discharge tray 35.

Each of the paper feed cassettes 21A to 21C and the paper feed tray 22 stores a bundle of paper sheets P. The paper feed cassettes 21A to 21C and the paper feed tray 22 store, for example, four different types of paper sheet P. Alternatively, paper sheets P of the same type may be stored in the paper feed cassettes 21A to 21C and the paper feed tray 22. The paper feed cassettes 21A to 21C and the paper feed tray 22 are provided with the paper feed rollers 23A to 23D, respectively. The inlets of the conveyance paths 30A to 30D are provided downstream of the paper feed rollers 23A to 23D, respectively.

The outlets of the conveyance paths 30A to 30D are all connected to the inlet of the conveyance path 30E. The outlet of the conveyance path 30E is provided upstream of the paper discharge rollers 34. The conveying rollers 31A and 32, the timing rollers 33, the secondary transfer roller 16, and the fixing device 17 are sequentially arranged between the inlet and outlet of the conveyance path 30E.

When a user selects any one of a plurality of types of paper sheet P stored in the paper feed cassettes 21A to 21C and the paper feed tray 22, the paper feed roller (for example, 23A) corresponding to the selected type of paper sheet P is rotationally driven to supply the paper sheet P to the conveying rollers 31A via the conveyance path (30A in this case) and the conveyance path 30E.

The conveying rollers 31A and 32 convey the paper sheet P supplied from the paper feed roller (23A in this case) to the timing rollers 33. The timing rollers 33 operate in synchronization with the full-color toner image transferred to the surface of the intermediate transfer belt 11, to supply the paper sheet P conveyed by the conveying rollers 31A and 32 to the nip between the secondary transfer roller 16 and the intermediate transfer belt 11. After passing through the nip between the secondary transfer roller 16 and the intermediate transfer belt 11, the paper sheet P passes through the fixing device 17, and is discharged by the paper discharge rollers 34 onto the paper discharge tray 35.

A basis weight detector 40 is provided between the conveying rollers 31A and 32 on the conveyance path 30E. The basis weight detector 40 detects the basis weight ($g/m^2$) of the paper sheet P passing through the conveyance path 30E, and outputs a signal indicating a detection value to the control device 51.

Figure 2:
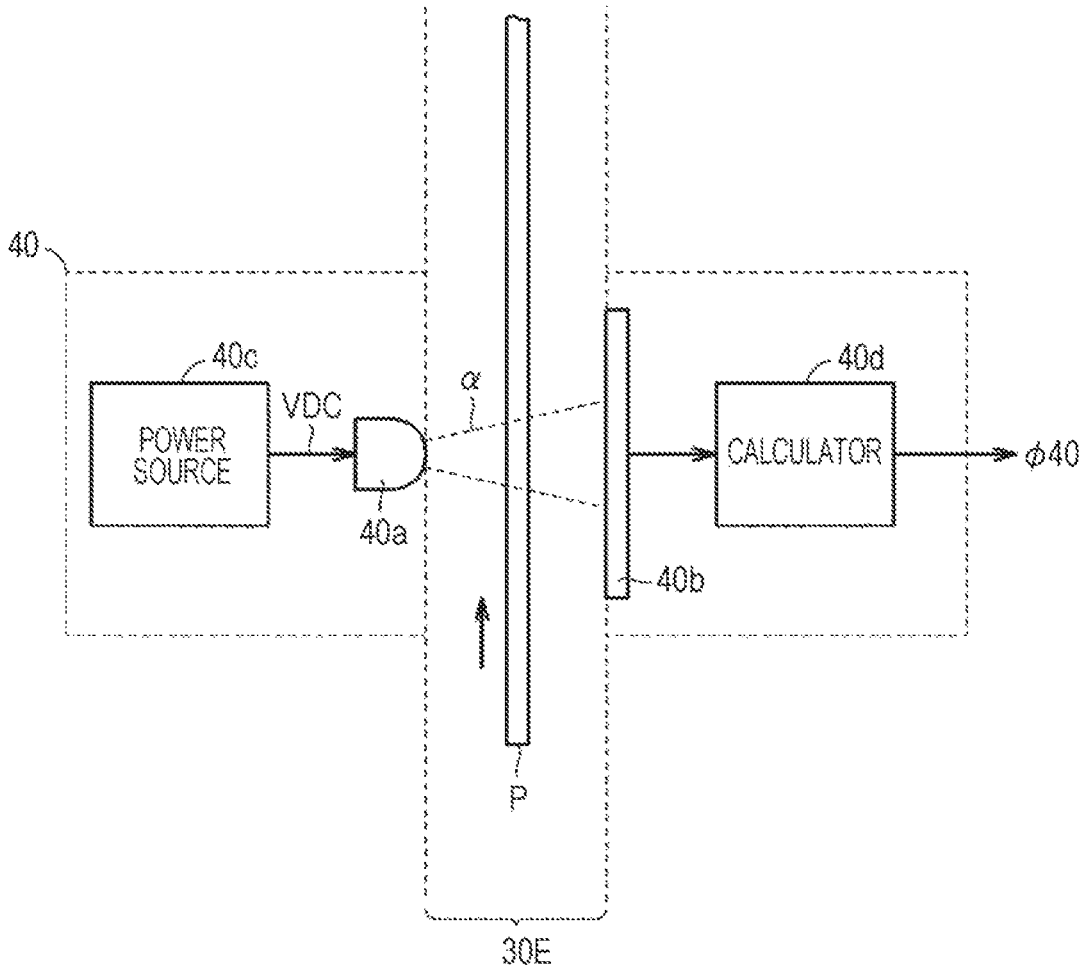
FIG. 2 is a diagram snowing a configuration of a basis weight detector shown in FIG. 1.

FIG. 2 is a diagram showing a configuration of the basis weight detector 40. In FIG. 2, the basis weight detector 40 includes a light emitting element 40*a*, a light receiving element 40*b*, a power source 40*c*, and a calculator 40*d*. The light emitting element 40*a* and the light receiving element 40*b* are disposed in such a way as to face each other with the paper sheet P, passing through the conveyance path 30E, interposed therebetween.

The power source 40*c* is controlled by the control device 51, to output a source voltage VDC. The source voltage VDC is controllable. The light emitting element 40*a* is driven by the source voltage VDC, to emit light α having an intensity corresponding to the source voltage VDC toward the light receiving element 40*b*. The light receiving element 40*b* outputs an electric signal (for example, a voltage signal) at a level corresponding to the intensity of the incident light α.

As the basis weight of the paper sheet P (that is, the thickness of the paper sheet P) increases, the light transmittance of the paper sheet P decreases. Therefore, when the paper sheet P exists between the light emitting element 40*a* and the light receiving element 40*b*, the intensity of the light α incident on the light receiving element 40*b* decreases as the basis weight of the paper sheet P increases. Thus, the level of an output signal from the light receiving element 40*b* decreases. When no paper sheet P exists between the light emitting element 40*a* and the light receiving element 40*b*, the level of an output signal from the light receiving element 40*b* is maximized.

Let A be the level of an output signal from the light receiving element 40*b* in the case where the paper sheet P exists between the light emitting element 40*a* and the light receiving element 40*b*, and let B be the level of an output signal from the light receiving element 40*b* in the case where no paper sheet P exists between the light emitting element 40*a* and the light receiving element 40*b*. Then, the basis weight of the paper sheet P is expressed as a function of A/B, that is, the ratio of A to B. The calculator 40*d* calculates the basis weight of the paper sheet P based on A/B, that is, the ratio of the minimum value A to the maximum value B of the level of the output signal from the light receiving element 40*b*. Then, the calculator 40*d* provides a signal φ 40 indicating the calculated basis weight to the control device 51.

Incidentally, in the case of providing the basis weight detector 40 as described above, an increase in the speed of conveying the paper sheet P increases the fluttering of the paper sheet P, and reduces time required for the paper sheet P to pass through the basis weight detector 40. Thus, while the speed of detecting a basis weight increases, accuracy in detection decreases. In contrast, a reduction in the speed of conveying the paper sheet P reduces the fluttering of the paper sheet P, and increases time required for the paper sheet P to pass through the basis weight detector 40. Thus, while accuracy in detection increases, a detection speed decreases, resulting in a decline in image productivity. Therefore, it is preferable to allow a user to select the speed of detecting the basis weight of the paper sheet P in consideration of a balance between accuracy in detection of the basis weight of the paper sheet P and productivity of an image.

Accordingly, the image forming apparatus 100 is provided with a high-speed detection mode and a high-precision detection mode. In the high-speed detection mode, the basis weight of the paper sheet P is detected at high speed while the conveying rollers 31A and 32 are caused to convey the paper sheet P at a relatively high speed Vf. In the high-precision detection mode, the basis weight of the paper sheet P is detected at low speed while the conveying rollers 31A and 32 are caused to convey the paper sheet P at a relatively low speed Vs. A user can select either of the high-speed detection mode and the high-precision detection mode by using the operation panel 50.

In the high-speed detection mode, the paper sheet P is conveyed at the high speed Vf. Therefore, while productivity of an image increases, accuracy in detection of a paper type decreases. Thus, there is a possibility that the quality of an image may be deteriorated. In contrast, in the high-precision detection mode, the paper sheet P is conveyed at the low speed Vs. Therefore, accuracy in detection of a paper type increases, and the quality of an image is enhanced. However, productivity of an image decreases. When giving priority to the productivity over quality of an image, a user selects the high-speed detection mode. When giving priority to the quality over productivity of an image, a user selects the high-precision detection mode.

Furthermore, the image forming apparatus 100 is also provided with a manual setting mode. In the manual setting mode, a user manually sets the type of paper sheet P without using the output signal from the basis weight detector 40. In the manual setting mode, since a paper type is specified, the conveying rollers 31A and 32 are caused to convey the paper sheet P at the relatively high speed Vf.

Returning to FIG. 1, the operation panel 50 includes a touch panel to be operated by a user. A user operates the operation panel 50 to set the number of prints, image density, an enlargement/reduction ratio, and the like to desired values. The operation panel 50 outputs, to the control device 51, a control signal indicating the result set by the user.

Furthermore, the user operates the operation panel 50 (selection part) to select one of the high-speed detection mode, the high-precision detection mode, and the manual setting mode. When the manual setting mode is selected, the user can operate the operation panel 50 (setting part) to set the type of paper sheet P selected from among the respective types of paper sheet P stored in the paper feed cassettes 21A to 21C and the paper feed tray 22. In addition, the operation panel 50 (notification part) displays, for each of the paper feed cassettes 21A to 21C and the paper feed tray 22, the paper type detected based on the result of detection by the basis weight detector 40, or the paper type manually set by the user.

Upon receiving an image signal from an external device (for example, a personal computer), the control device 51 generates image data in four colors from the image signal, and provides the imaging units 14C, 14M, 14Y, and 14K with the respective image data generated in four colors. Moreover, the control device 51 controls the printing part 10 and the paper conveying part 20, based on the control signal from the operation panel 50, to print the toner image on the paper sheet P.

In particular, when the high-speed detection mode is selected by the user, the control device 51 controls the conveying rollers 31A and 32 to cause the paper sheet P to be conveyed at the high speed Vf. In addition, the control device 51 selects one of M paper types, and selects image forming conditions corresponding to the selected paper type, based on the output signal from the basis weight detector 40 and a table Tf for the high-speed detection mode. Then, the control device 51 controls the printing part 10 under the selected image forming conditions, to print the toner image on the paper sheet P. M is an integer equal to or larger than 2. For example, M is 7. The table Tf for the high-speed detection mode will be described below.

Furthermore, when the high-precision detection mode is selected by the user, the control device 51 controls the conveying rollers 31A and 32 to cause the paper sheet P to be conveyed at the low speed Vs. In addition, the control device 51 selects one of N paper types, and selects image forming conditions corresponding to the selected paper type, based on the output signal from the basis weight detector 40 and a table Ts for a low-speed detection mode. Then, the control device 51 controls the printing part 10 under the selected image forming conditions, to print the toner image on the paper sheet P. N is an integer larger than M. For example, N is 14. The table Ts for the low-speed detection mode will be described below.

Furthermore, when the user selects the manual setting mode and sets the paper type of the paper sheet P, the control device 51 controls the conveying rollers 31A and 32 to cause the paper sheet P to be conveyed at the high speed Vf. In addition, based on the set paper type and a table Tf for the manual setting mode, the control device 51 selects image forming conditions corresponding to the paper type. Then, the control device 51 controls the printing part 10 under the selected image forming conditions, to print the toner image on the paper sheet P.

Note that the control device 51 includes, as main elements, a processor such as a central processing unit (CPU), a volatile memory such as a dynamic random access memory (DRAM), a nonvolatile memory such as a hard disk drive (HDD), and various interfaces. Typically, in the control device 51, the processor executes various programs stored in the nonvolatile memory. As a result, processing such as that relating to image formation in the image forming apparatus 100 is performed.

Furthermore, instead of causing the processor to execute the programs, all or a part of processing by the processor may be implemented by use of dedicated hardware. Moreover, when the processor executes a program, the program may be installed in the nonvolatile memory via various recording media, or may be downloaded from a server device (not shown) or the like via a communication line.

Next, operation of the image forming apparatus 100 will be briefly described. A user selects one of the four types of paper sheet P set in the paper feed cassettes 21A to 21C and the paper feed tray 22, and also selects one of the high-speed detection mode, the high-precision detection mode, and the manual setting mode, by using the operation panel 50. As a result, the selected paper sheet P is conveyed by corresponding one of the paper feed rollers 23A to 23D, and the conveying rollers 31A and 32 at the speed Vf or Vs according to the selected mode. Then, the paper sheet P is supplied, by the timing rollers 33, to the nip between the secondary transfer roller 16 and the intermediate transfer belt 11.

In addition, when the high-speed detection mode or the high-precision detection mode is selected, the basis weight of the paper sheet P is detected by the basis weight detector 40. Then, the control device 51 selects image forming conditions corresponding to the detected basis weight, and provides the image forming conditions to the printing part 10. When the manual setting mode is selected, the paper type of the paper sheet P is set by the user. Then, the control device 51 selects image forming conditions corresponding to the set paper type, and provides the image forming conditions to the printing part 10.

Furthermore, when an image signal is provided from an external device (for example, a personal computer), the control device 51 generates image data in four colors from the image signal, and provides the imaging units 14C, 14M, 14Y, and 14K with the respective image data generated in four colors.

In each imaging unit 14, the surface of the photosensitive drum 1 is uniformly charged by the charger 2, and exposed by the exposure part 3. Thus, an electrostatic latent image is formed on the surface of the photosensitive drum 1 according to the corresponding image data. The electrostatic latent image on the surface of the photosensitive drum 1 is developed by the developing device 4 to form a toner image. The toner images formed in four colors on the surfaces of the four photosensitive drums 1 included in the four imaging units 14 are sequentially transferred to the surface of the intermediate transfer belt 11 by the primary transfer rollers 5, and superimposed thereon to form a full-color toner image.

The toner image formed on the surface of the intermediate transfer belt 11 is transferred, by the secondary transfer roller 16, to the paper sheet P supplied from the timing rollers 33, and fixed on the paper sheet P by the fixing device 17. Then, the paper sheet P is discharged by the paper discharge rollers 34 to the paper discharge tray 35. Furthermore, toner remaining on the surface of the photosensitive drum 1 is removed by the cleaner 6. In addition, toner remaining on the surface of the intermediate transfer belt 11 is removed by the cleaner 18.

Each of a processing speed in the printing part 10, a transfer voltage at the transfer rollers 5 and 16, and a fixing temperature at the fixing device 17, included in the image forming conditions, is set to an appropriate value according to the basis weight (that is, thickness) of the paper sheet P. Therefore, the image forming apparatus 100 is capable of printing a satisfactory image on the paper sheet P, regardless of the type of the paper sheet P.

Figure 3:
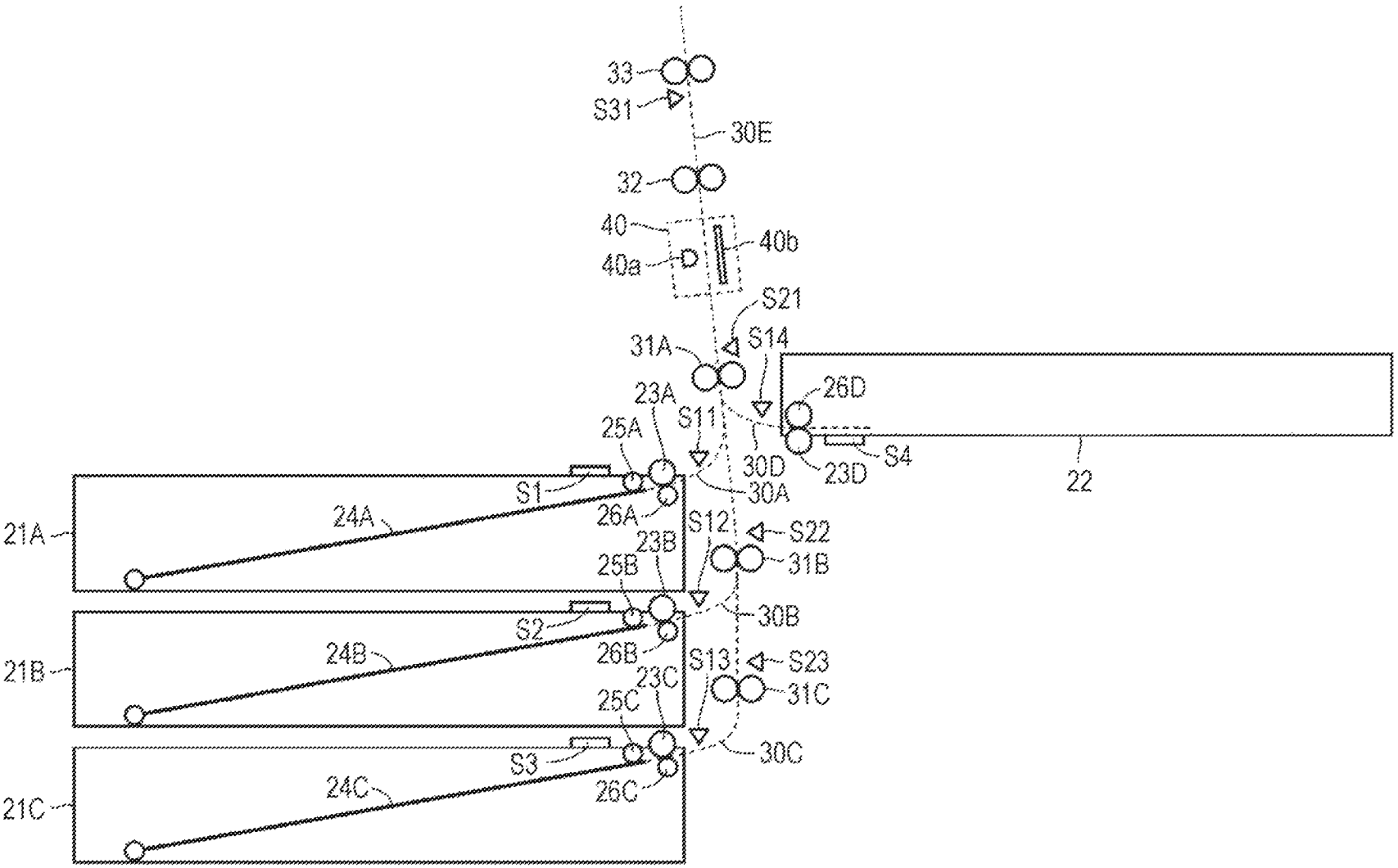
FIG. 3 is a diagram showing a detailed configuration of a paper conveying part shown in FIG. 1.
Figure 4:
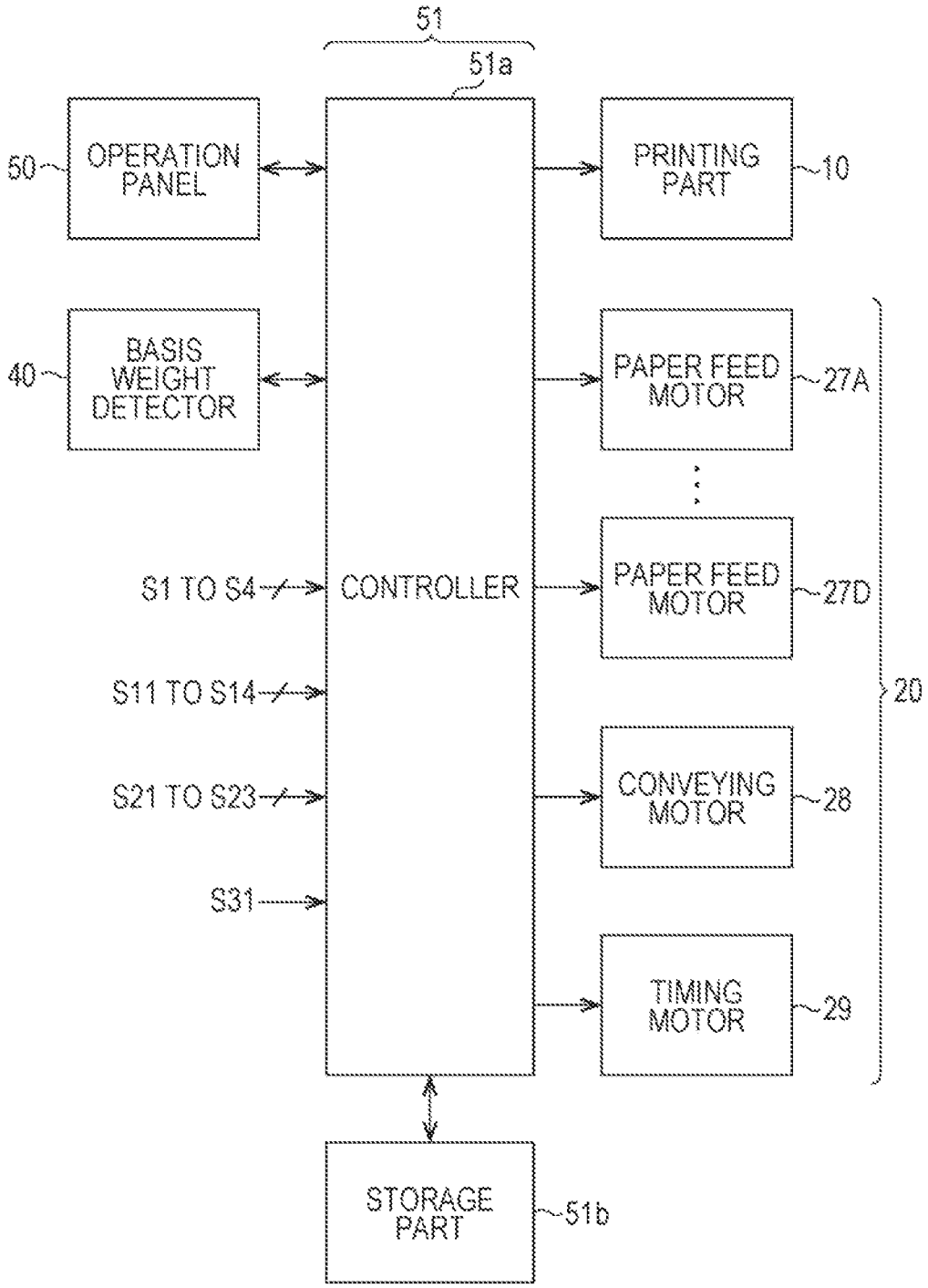
FIG. 4 is a block diagram for describing a method for controlling a printing part and the paper conveying part shown in FIGS. 1 to 3.

FIG. 3 is a diagram showing a detailed configuration of the paper conveying part 20. FIG. 4 is a block diagram for describing a method for controlling the printing part 10 and the paper conveying part 20. In FIG. 3, the paper conveying part 20 further includes empty sensors S1 to S4, push-up plates 24A to 24C, pickup rollers 25A to 25C, separation rollers 26A to 26D, paper feed sensors S11 to S14, conveying rollers 31B and 31C, conveyance sensors S21 to S23, and a timing sensor S31. Furthermore, in FIG. 4, the control device 51 includes a controller 51*a* and a storage part 51*b*, and the paper conveying part 20 further includes paper feed motors 27A to 27D, a conveying motor 28, and a timing motor 29.

The controller 51*a* controls the rotational speed of each of the motors 27A to 27D, 28, and 29 based on output signals from the operation panel 50 and the sensors S1 to S4, S11 to S14, S21 to S23, and S31. The paper feed motor 27A rotationally drives the pickup roller 25A, the paper feed toiler 23A, and the separation roller 26A. The paper feed motor 27B rotationally drives the pickup roller 25B, the paper feed roller 23B, and the separation roller 26B. The paper feed motor 27C rotationally drives the pickup roller 25C, the paper feed roller 23C, and the separation roller 26C. The paper feed motor 27D rotationally drives the paper feed roller 23D and the separation roller 26D. The conveying motor 28 rotationally drives the conveying rollers 31A to 31C, and 32. The timing motor 29 rotationally drives the timing roller 33.

The empty sensors S1 to S4 determine whether the paper feed cassettes 21A to 21C and the paper feed tray 22 are loaded with the paper sheets P, respectively, and provide the controller 51*a* with signals indicating the results of determination. When another type of paper sheet P than the paper sheets P loaded in the paper feed cassettes 21A to 21C and the paper feed tray 22 is selected by a user, the controller 51*a* causes the operation panel 50 to display an indication to that effect, and does not start printing operation, based on the output signals from the empty sensors S1 to S4. When the paper sheets P loaded in one of the paper feed cassettes 21A to 21C and the paper feed tray 22 are selected by the user, the controller 51*a* controls the printing part 10 and the paper conveying part 20 to start printing operation, based on the output signals from the empty sensors S1 to S4.

The push-up plates 24A to 24C are provided in the paper feed cassettes 21A to 21C, respectively. The rear end portions (left end portions in the drawing) of the push-up plates 24A to 24C are swingably supported by support members at the rear end portions of the bottom faces of the paper feed cassettes 21A to 21C, respectively. When the paper feed cassettes 21A to 21C are removed from the image forming apparatus 100, the push-up plates 24A to 24C are disposed along the bottom faces of the paper feed cassettes 21A to 21C, respectively.

When the paper feed cassette (for example, 21A) is inserted into the image forming apparatus 100 with a bundle of paper sheets P loaded onto the surface of the push-up plate (24A in this case), the front end portion (right end portion in the drawing) of the push-up plate 24A is biased upward by an elastic member (not shown). Thus, the front end portion of the bundle of paper sheets P is sandwiched between the pickup roller (25A in this case) and the push-up plate 24A.

The pickup rollers 25A to 25C are provided to correspond to the paper feed cassettes 21A to 21C, respectively. The separation rollers 26A to 26D are provided to correspond to the paper feed rollers 23A to 23D, respectively. The separation roller 26 and the corresponding paper feed roller 23 forms a nip.

Note that in order to simplify description, some elements are described as follows in some cases. For example, one of the paper feed cassettes 21A to 21C is referred to as the paper feed cassette 21. One of the paper feed rollers 23A to 23D, as a representative, is referred to as the paper feed roller 23. One of the pickup rollers 25A to 25C, as a representative, is referred to as the pickup roller 25. One of the separation rollers 26A to 26D, as a representative, is referred to as the separation roller 26. One of the paper feed motors 27A to 27D, as a representative, is referred to as the paper feed motor 27. One of the conveying rollers 31A to 31C is referred to as the conveying roller 31.

When the paper sheets P in the paper feed cassette 21 are selected by a user, the pickup roller 25 corresponding to the paper feed cassette 21 is rotationally driven by the corresponding paper feed motor 27 to pick up the paper sheets P in the paper feed cassette 21 one by one, and to supply each of the paper sheets P to the nip between the corresponding paper feed roller 23 and separation roller 26. At that time, there are cases where two paper sheets P are fed (double-fed) together at a time to reach the paper feed roller 23. In that case, the two paper sheets P are separated and fed one by one, by the nip between the paper feed roller 23 and the separation roller 26. When the paper sheets P in the paper feed tray 22 are selected by a user, the paper feed roller 23D and the separation roller 26D, corresponding to the paper feed tray 22, are rotationally driven by the paper feed motor 27D to separate and feed the paper sheets P in the paper feed tray 22 one by one.

The paper feed sensors S11 to S14 are provided at the inlets of the conveyance paths 30A to 30D, respectively. The paper feed sensors S11 to S14 detect whether a double feed state has been cleared by the paper feed rollers 23A to 23D, respectively, and output signals indicating the results of detection to the controller 51*a*. When it is detected by the paper feed sensors S11 to S14 that the double feed state has not been cleared, the controller 51*a* determines that a paper jam has occurred. Then, the controller 51*a* causes the operation panel 50 to display an indication to that effect, and also causes the printing part 10 and the paper conveying part 20 to stop printing operation.

The conveying rollers 31A are disposed at the inlet of the conveyance path 30E. The conveying rollers 31B and 31C are disposed on the conveyance paths 30B and 30C, respectively. The conveyance sensors S21 to S23 are disposed downstream of the conveying rollers 31A to 31C, respectively. The conveyance sensors S21 to S23 detect the front edge of the paper sheet P when the paper sheet P passes through the conveying rollers 31A to 31C, respectively, and output signals indicating the results of detection to the controller 51*a*.

After the double feed state is cleared by the nip between the paper feed roller 23 and the separation roller 26, the paper sheet P is conveyed to the conveying roller 31, with the paper feed roller 23 as a drive source. The pickup roller 25, the paper feed roller 23, and the separation roller 26 are driven by the paper feed motor 27, and stop when one paper sheet P is conveyed to the corresponding conveying roller 31. The paper sheet P conveyed to the conveying roller 31 is then conveyed to the timing roller 33 by the conveying rollers 31 and 32.

When the high-speed detection mode is selected by a user, the controller 51*a* controls the conveying motor 28 to cause the paper sheet P to be conveyed at the high speed Vf. Furthermore, when the high-precision detection mode is selected by a user, the controller 51*a* controls the conveying motor 28 to cause the paper sheet P to be conveyed at the low speed Vs. Moreover, when the manual setting mode is selected by a user, the controller 51*a* controls the conveying motor 28 to cause the paper sheet P to be conveyed at the high speed Vf.

Here, the paper feed speeds of the pickup roller 25, the paper feed roller 23, and the separation roller 26 are higher than the paper feed speed Vf or Vs of the conveying roller 31. In the case of successively conveying the paper sheets P, the controller 51*a* adjusts a time period from the time when the pickup roller 25, the paper feed roller 23, and the separation roller 26 complete conveyance of the preceding paper sheet P to the time when the pickup roller 25, the paper feed roller 23, and the separation roller 26 start conveyance of the following paper sheet P. Thus, the controller 51*a* controls the space (sheet interval) between the preceding paper sheet P and the following paper sheet P. This control is performed based on the results of detection by the paper feed sensors S11 to S14 and the conveyance sensors S21 to S23.

Furthermore, when the high-speed detection mode is selected by a user, it is necessary to detect the light transmittance of the paper sheet P to be conveyed at the high speed Vf. Therefore, the controller 51*a* controls the power source 40*c* to set the source voltage VDC to a high level, so that the intensity of the light α to be emitted from the light emitting element 40*a* is set to a high level. In addition, when the high-precision detection mode is selected by a user, the light transmittance of the paper sheet P just needs to be detected while the paper sheet P is conveyed at the low speed Vs. Thus, the controller 51*a* controls the power source 40*c* to set the source voltage VDC to a low level, so that the intensity of the light α to be emitted from the light emitting element 40*a* is set to a low level.

The timing sensor S31 is provided upstream of the timing roller 33. The timing sensor S31 detects the front edge of the paper sheet P, and provides the controller 51*a* with a signal indicating the result of detection. Based on the output signal from the timing sensor S31, the controller 51*a* aligns the front edge of the paper sheet P with the timing roller 33.

At the time of image formation, the controller 51*a* controls the timing motor 29 to cause the paper sheet P to be conveyed from the timing roller 33 to the secondary transfer roller 16 (FIG. 1), and also to cause a toner image on the intermediate transfer belt 11 to be conveyed to the secondary transfer roller 16 in such a way as to coincide with the passage of the paper sheet P through the secondary transfer roller 16. The toner image is transferred from the intermediate transfer belt 11 to the paper sheet P by the secondary transfer roller 16. Then, the toner image transferred to the paper sheet P is fixed on the paper sheet P by the fixing device 17. The paper sheet P on which the toner image has been fixed is discharged to the paper discharge tray 35 by the paper discharge roller 34 (FIG. 1).

FIGS. 5A and 5B are diagrams showing the tables Tf and Ts stored in the storage part 51*b* (FIG. 4). The table Tf is a table to be referred to by the controller 51*a* in each of the high-speed detection mode and the manual setting mode. The table Ts is a table to be referred to by the controller 51*a* in the high-precision detection mode.

Listed in the table Tf, shown in FIG. 5A, are seven paper types (names and basis weights) and seven sets of image forming conditions (processing speed, fixing temperature, and transfer voltage) corresponding to the seven paper types. That is, the names of the seven paper types (thin paper, plain paper, and thick paper 1 to thick paper 5) are listed in the first column (leftmost column) of the table Tf. Seven paper type categories, that is, the ranges (51 to 60, 61 to 90, . . . , and 261 to 300) of basis weight (g/m$^2$) are listed in the second column of the table Tf.

Two processing speeds (mm/s) (200 and 100) are listed in the third column of the table Tf. When the paper type of the paper sheet P is thin paper or plain paper, the processing speed is set to 200 mm/s. When the paper type of the paper sheet P is any one of thick paper 1 to thick paper 5, the processing speed is set to 100 mm/s. Seven fixing temperatures (° C.) (145, 165, 140, 150, . . . , and 170) are listed in the fourth column of the table Tf. Seven transfer voltages (V) (1500, 1800, 1300, 1600, . . . , and 2500) are listed in the fifth column of the table Tf.

According to the table Tf, as the basis weight (g/m$^2$) of the paper sheet P increases, the processing speed (mm/s) is decreased, the fixing temperature (° C.) is increased, and the transfer voltage (V) is increased. This is because, as the basis weight (g/m$^2$) of the paper sheet P increases, the paper sheet P becomes thick, so that a larger amount of heat and a larger electric field are required for surely transferring and fixing a toner image onto the paper sheet P.

When a user selects the high-speed detection mode by using the operation panel 50, the controller 51*a* controls the conveying motor 28 to cause the paper sheet P to be conveyed at the high speed Vf. In addition, the controller 51*a* detects the basis weight (g/m$^2$) of the paper sheet P based on the output signal φ 40 from the basis weight detector 40. The high speed Vf is set to, for example, a processing speed of 200 mm/s intended for the case where the paper sheet P is categorized as plain paper. Based on the basis weight (g/m$^2$) and the table Tf for the high-speed detection mode, the controller 51*a* selects one of the seven paper type categories, and selects image forming conditions corresponding to the paper type category.

For example, when the basis weight of the paper sheet P is 80 g/m$^2$, it is determined that the paper sheet P is categorized as plain paper (61 to 90 g/m$^2$) listed in the second row of the table Tf. Thus, image forming conditions (200 mm/s, 165° C. and 1800 V) corresponding thereto are selected. Then, the controller 51*a* controls the printing part 10 under the selected image forming conditions, to print the toner image on the paper sheet P. Furthermore, the controller 51*a* stores the selected paper type in the storage part 51*b*, and causes the operation panel 50 to display the paper type stored in the storage part 51*b* at the time of notification.

When a user selects the manual setting mode and sets a paper type category of the paper sheet P to be used, by using the operation panel 50, the controller 51*a* controls the conveying motor 28 to cause the paper sheet P to be conveyed at the high speed Vf. In addition, based on the set paper type category and the table Tf for the manual setting mode, the controller 51*a* selects image forming conditions corresponding to the paper type category.

For example, when the paper type category is set to thick paper 2 (121 to 160 g/m$^2$) listed in the fourth row of the table Tf, there are selected image forming conditions (100 mm/s, 150° C., and 1600 V) corresponding to thick paper 2 set as the paper type category. Then, the controller 51*a* controls the printing part 10 under the selected image forming conditions, to print the toner image on the paper sheet P. In addition, the controller 51*a* stores the set paper type in the storage part 51*b*, and causes the operation panel 50 to display the paper type stored in the storage part 51*b* at the time of notification.

Furthermore, listed in the table Ts, shown in FIG. 5B, are names of seven paper types, fourteen paper type categories (basis weight ranges), and fourteen sets of image forming conditions (processing speed, fixing temperature, and transfer voltage) corresponding to the fourteen paper type categories.

That is, the names of the seven paper types (thin paper, plain paper, and thick paper 1 to thick paper 5) are listed in the first column (leftmost column) of the table Ts. Fourteen paper type categories, that is, the ranges (51 to 55, 56 to 60, 61 to 75, . . . , and 281 to 300) of basis weight (g/m$^2$) are listed in the second column of the table Ts. The fourteen paper type categories are provided in the table Ts as a result of dividing, into two, each of the seven paper type categories shown in the table Tf.

Two processing speeds (mm/s) (200 and 100) are listed in the third column of the table Ts. Fourteen fixing temperatures (° C.) (140, 145, 160, 165, 135, 140, . . . , and 170) are listed in the fourth column of the table Ts. Fourteen transfer voltages (V) (1450, 1550, 1750, 1850, 1200, 1400, . . . , and 2600) are listed in the fifth column of the table Ts.

According to the table Ts, as the basis weight (g/m$^2$) of the paper sheet P increases, the processing speed (mm/s) is decreased, the fixing temperature (° C.) is increased, and the transfer voltage (V) is increased. This is because, as the basis weight (g/m$^2$) of the paper sheet P increases, the paper sheet P becomes thick, so that a larger amount of heat and a larger electric field are required for surely transferring and fixing a toner image onto the paper sheet P.

Furthermore, the number (fourteen) of the paper type categories in the table Ts for the high-precision detection mode is larger than the number (seven) of the paper type categories in the table Tf for the high-speed detection mode. This is because the basis weight (g/m$^2$) of the paper sheet P can be detected with higher precision in the high-precision detection mode than in the high-speed detection mode. Thus, finer paper type categories are provided, and there are set image forming conditions corresponding to the respective paper type categories, so as to obtain a satisfactory image.

When a user selects the high-precision detection mode by using the operation panel 50, the controller 51*a* controls the conveying motor 28 to cause the paper sheet P to be conveyed at the low speed Vs (for example, 100 mm/s). In addition, the controller 51*a* detects the basis weight (g/m$^2$) of the paper sheet P based on the output signal φ 40 from the basis weight detector 40. The low speed Vs is set to, for example, a processing speed of 100 mm/s intended for the case where the paper sheet P is categorized as one of thick paper 1 to thick paper 5. Based on the basis weight (g/m$^2$) and the table Ts for the high-precision detection mode, the controller 51*a* selects one of the fourteen paper type categories, and selects image forming conditions corresponding to the paper type category.

For example, when the basis weight of the paper sheet P is 80 g/m$^2$, it is determined that the paper type category of the paper sheet P is plain paper (76 to 90 g/m$^2$) listed in the fourth row of the table Ts. Thus, image forming conditions (200 mm/s, 165° C., and 1850 V) corresponding to the paper type category are selected. Then, the controller 51*a* controls the printing part 10 under the selected image forming conditions, to print the toner image on the paper sheet P. Furthermore, the controller 51*a* stores the selected paper type in the storage part 51*b*, and causes the operation panel 50 to display the paper type stored in the storage part 51*b* at the time of notification.

FIGS. 6A and 6B are diagrams showing images to be displayed on the operation panel 50. In particular, FIG. 6A shows an image for mode selection, and FIG. 6B shows an image for notification. As shown in FIG. 6A, terms "paper feeder 1" to "paper feeder 4" are shown in the first to fourth rows of the first column (leftmost column), respectively, in the image for mode selection. "Paper feeder 1" to "paper feeder 4" correspond to the paper feed cassettes 21A to 21C and the paper feed tray 22, respectively.

Three touch buttons labeled "manual," "automatic 1," and "automatic 2" are arranged in each row. "Manual," "automatic 1," and "automatic 2" correspond to the manual setting mode, the high-speed detection mode, and the high-precision detection mode, respectively. It is possible to select one of the manual setting mode, the high-speed detection mode, and the high-precision detection mode by touching one of the three touch buttons ("manual," "automatic 1," and "automatic 2") in each row.

When the touch button "manual" is touched, the screen changes from the image for mode selection to an image for paper type settings. In the image for paper type settings, it is possible to select and set, for example, one of the seven paper type categories shown in FIG. 5A. Generally, the basis weight (g/m$^2$) of the paper sheet P is stated on the packing paper of a bundle of the paper sheets P. A user selects and sets a paper type category to which the basis weight (g/m$^2$) stated on the packing paper belongs. Alternatively, it is also possible to adopt a configuration in which a paper type category to which the paper sheet P belongs is automatically selected and set in response to a user's numerical input of the basis weight of the paper sheet P in the image for paper type settings. When the paper type is set by the user, the screen changes from the image for paper type settings to the image for mode selection.

Furthermore, when the touch button is touched, the state of the touch button (for example, brightness, color, and negative/positive) changes. In FIG. 6A, touch buttons corresponding to the set modes are shaded by diagonal lines. FIG. 6A shows a case where the modes of the paper feeder 1 to the paper feeder 4 have been set to the high-precision detection mode, the high-speed detection mode, the manual setting mode, and the manual setting mode, respectively.

Furthermore, as shown in FIG. 6B, the image for notification shows the name and basis weight range of a paper type automatically detected or manually set for each of the paper feeder 1 to the paper feeder 4. FIG. 6B shows a case where a message "loaded with plain paper (61 to 90 g/m2)" has been provided for each of the paper feeder 1, the paper feeder 3, and the paper feeder 4, and a message "loaded with thick paper 1 (91 to 120 g/m2)" has been provided for the paper feeder 2. If the previous detection result is valid, the previous detection result is displayed even in the case where a paper type is to be detected at the time of the next paper feed.

Furthermore, in FIGS. 6A and 6B, "automatic 2" (high-precision detection mode) has been selected for the paper feeder 1. In addition, the message "loaded with plain paper (61 to 90 g/m$^2$)" has been provided for the paper feeder 1. As shown in FIG. 5A, a single paper type category (61 to 90 g/m$^2$) is provided for plain paper in the high-speed detection mode. Moreover, as shown in FIG. 5B, two paper type categories (61 to 75 g/m$^2$ and 76 to 90 g/m$^2$) are provided for plain paper in the high-precision detection mode.

However, the paper type for the high-speed detection mode, that is, "plain paper (61 to 90 g/m$^2$)" is displayed on the operation panel 50, regardless of whether the paper sheet P falls into the paper type category of 61 to 75 g/m$^2$ or the paper type category of 76 to 90 g/m$^2$ in the high-precision detection mode. This is to make a paper type easy for a user to understand by displaying the result of detection in the high-precision detection mode and the result of detection in the high-speed detection mode in the same manner, to simply display the paper type.

FIGS. 7A and 7B are diagrams showing other images to be displayed on the operation panel 50, which are to be compared with FIGS. 6A and 6B. As with FIG. 6A, FIG. 7A shows an image for mode selection. An image for notification, shown in FIG. 6B, shows the name and basis weight range of a paper type automatically detected for each of the paper feeder 1 and the paper feeder 2. However, there are cases where automatic detection has not been performed, or the paper feed cassette 21A or 21B is removed/inserted by a user after automatic detection. In such a case, as shown in FIG. 7B, a message "automatic detection to be performed in the high-precision mode" is provided for the paper feeder 1. In addition, a message "automatic detection to be performed in the high-speed mode" is provided for the paper feeder 2. Note that a message "a paper type is unknown" may be provided for each of the paper feeder 1 and the paper feeder 2.

As described above, according to the first embodiment, when a user selects the high-speed detection mode or the high-precision detection mode by using the operation panel 50, the paper sheet P is conveyed by the conveying rollers 31A to 31C and 32 at the conveyance speed Vf or Vs corresponding to the selected mode. Then, the basis weight (g/m$^2$) of the paper sheet P being conveyed is detected by the basis weight detector 40. Thus, image forming conditions are changed based on the selected mode and the detected basis weight (g/m$^2$). Therefore, a user can select the speed of detecting a paper type. In addition, a satisfactory image can be formed according to the paper type.

Note that the basis weight (g/m$^2$) of the paper sheet P is detected as a characteristic of the paper sheet P, and the paper type of the paper sheet P is determined based on the detection result in the first embodiment. However, the present invention is not limited thereto. It is also possible to detect the reflectance, thickness, water content, surface condition, and the like of the paper sheet P and to determine the paper type of the paper sheet P based on the detection results. Note that characteristics of the paper sheet P do not include information on the size of the paper sheet P.

Furthermore, the basis weight (g/m$^2$) of the paper sheet P is detected by use of a transmission-type optical sensor including the light emitting element 40*a* and the light receiving element 40*b*, in the first embodiment. However, the present invention is not limited thereto. Any sensor may be used for detecting characteristics of the paper sheet P. For example, the reflectance of the paper sheet P may be detected by use of a reflective optical sensor including a light emitting element that emits light to the paper sheet P and a light receiving element that receives light reflected by the paper sheet P. In addition, characteristics of the paper sheet P may be detected by use of, for example, a displacement sensor for detecting the thickness of the paper sheet P, a capacitance sensor for detecting the water content of the paper sheet P, a camera for imaging surface conditions of the paper sheet P, and an ultrasonic sensor using ultrasonic waves instead of light.

Moreover, one of the high-speed detection mode, the high-precision detection mode, and the manual setting mode is selected by use of the operation panel 50 in the first embodiment. However, the present invention is not limited thereto. It is also possible to separately provide a selector, a switch, or the like for selecting one of the high-speed detection mode, the high-precision detection mode, and the manual setting mode.

In addition, the same table Tf (FIG. 5A) is used in the high-speed detection mode and the manual setting mode in the first embodiment. However, the present invention is not limited thereto. Different tables may be used in the high-speed detection mode and the manual setting mode.

Furthermore, in the first embodiment, the conveyance speed Vf of the paper sheet P in the high-speed detection mode and the manual setting mode has been set to a processing speed of 200 mm/s for plain paper. In addition, the conveyance speed Vs of the paper sheet P in the high-precision detection mode has been set to a processing speed of 100 mm/s for thick paper. However, the present invention is not limited thereto. The conveyance speeds Vf and Vs of the paper sheet P may be set to speeds unrelated to the processing speeds in image formation. The conveyance speeds Vf and Vs of the paper sheet P may be higher or lower than the processing speeds in image formation.

Second Embodiment

FIGS. 8A and 8B are diagrams showing tables Tf and Ts1 to be used in an image forming apparatus according to a second embodiment of the present invention, which are to be compared with FIGS. 5A and 5B. With reference to, FIGS. 8A and 8B, the image forming apparatus differs from the image forming apparatus 100 according to the first embodiment in that a table Ts1 for a high-precision detection mode is stored in a storage part 51*b*, instead of the table Ts for the high-precision detection mode.

Seven paper type categories (basis weight ranges) are provided in a table Tf for a high-speed detection mode. Fourteen paper type categories are provided in the table Ts1 for the high-precision detection mode, as a result of addition of one paper type category to at least each boundary between two adjacent paper type categories shown in the table Tf.

That is, seven paper type categories of thin paper, plain piper, thick paper 1, thick paper 2, thick paper 3, thick paper 4, and thick paper 5 are provided in the first to seventh rows of the table Tf for the high-speed detection mode. The table Ts1 for the high-precision detection mode shows paper type categories of thin paper (56 to 65 g/m$^2$), plain paper (86 to 95 g/m$^2$), thick paper 1 (116 to 125 g/m$^2$), thick paper 2 (155 to 165 g/m$^2$), thick paper 3 (206 to 215 g/m$^2$), and thick paper 4 (256 to 265 g/m$^2$), which have been added to the six boundaries between two adjacent ones of the paper type categories of thin paper, plain paper, thick paper 1, thick paper 2, thick paper 3, thick paper 4, and thick paper 5 shown in the table Tf, respectively. Furthermore, thick paper 5 (285 to 305 g/m$^2$) has also been added.

Moreover, in association with the addition of the seven new paper type categories, adjustments have been made so as to reduce the basis weight ranges of the seven original paper type categories in the table Ts1 for the high-precision detection mode. That is, as a result of the adjustments, the original basis weight ranges of thin paper (51 to 60 g/m$^2$), plain paper (61 to 90 g/m$^2$), thick paper 1 (91 to 120 g/m$^2$), thick paper 2 (121 to 160 g/m$^2$), thick paper 3 (161 to 210 g/m$^2$), thick paper 4 (211 to 260 g/m$^2$), and thick paper 5 (261 to 300 g/m$^2$) have been changed to thin paper (51 to 55 g/m$^2$), plain paper (66 to 85 g/m$^2$), thick paper 1 (96 to 115 g/m$^2$), thick paper 2 (126 to 155 g/m$^2$), thick paper 3 (166 to 205 g/m$^2$), thick paper 4 (216 to 255 g/m$^2$), and thick paper 5 (266 to 285 g/m$^2$), respectively. Furthermore, there are set image forming conditions (processing speed, fixing temperature, and transfer voltage) specific to each of the fourteen paper type categories.

Other configurations and operations are the same as those in the first embodiment. Thus, description thereof will not be repeated. In the second embodiment, the table Ts1 has been created by addition of the new paper type categories to the boundaries between the paper type categories shown in the table Tf. Therefore, compared with the first embodiment, it is possible to reduce a detection error at the boundary between the paper type categories.

Third Embodiment

FIGS. 9A and 9B are diagrams showing tables Tf and Ts1 to be used in an image forming apparatus according to a third embodiment of the present invention, which are to be compared with FIGS. 5A and 5B. With reference to, FIGS. 9A and 9B, the image forming apparatus differs from the image forming apparatus 100 according to the first embodiment in that a table Ts2 for a high-precision detection mode is stored in a storage part 51*b*, instead of the table Ts for the high-precision detection mode.

Seven paper type categories (basis weight ranges) are provided in a table Tf for a high-speed detection mode. In the table Ts2 for the high-precision detection mode, each of thin paper (51 to 60 g/m$^2$) and plain paper (61 to 90 g/m$^2$) has been divided into two. Thin paper (51 to 60 g/m$^2$) and plain paper (61 to 90 g/m$^2$) are two paper type categories corresponding to the smallest basis weights (g/m$^2$) among those of the seven paper type categories shown in the table Tf. This is because a curl amount for the paper sheet P having a small basis weight (g/m$^2$) significantly changes relative to a change in fixing temperature, and it is thus preferable to increase the number of paper type categories.

Furthermore, in the table Ts2 for the high-precision detection mode, the paper type category of thick paper 1 (91 to 120 g/m$^2$) has been divided into two, which is a paper type category corresponding to a processing speed reduced from 200 to 100 mm/s among the seven paper type categories shown in the table Tf. This is because a fixing temperature condition and a transfer voltage condition significantly change in a range where a processing speed is switched, and it is thus preferable to increase the number of paper type categories. Among the seven paper type categories shown in the table Tf, paper type categories corresponding to larger basis weights (g/m$^2$) are the same as those in the table Ts2.

Other configurations and operations are the same as those in the first embodiment. Thus, description thereof will not be repeated. In the third embodiment, the number of paper type categories is increased when image forming conditions significantly change. In other cases, the number of paper type categories is not increased. Thus, it is possible to achieve simplification of the table for high-precision detection.

Fourth Embodiment

FIG. 10 is a diagram for describing operation of an image forming apparatus according to a fourth embodiment of the present invention, which is to be compared with FIG. 5B. As shown in FIG. 10, a table Ts for a high-precision detection mode which is the same as that in the first embodiment is used in the image forming apparatus.

A control device 51 stores the number of times of detection for each paper type category when a paper type category is detected in the high-precision detection mode. Let n1 be the number of times of detection of one of two paper type categories having the same name, and let n2 be the number of times of detection of the other paper type category. Then the control device 51 determines whether the value (%) of 100×n1/(n1+n2) exceeds a threshold value (for example, 90%).

FIG. 10 shows the following case regarding plain paper (61 to 75 g/m$^2$) and plain paper (76 to 90 g/m$^2$) as two paper type categories having the same name: the number of times of detection n1 of plain paper (61 to 75 g/m$^2$), which is one of the two paper type categories, is equal to or larger than the number of times of detection n2 of the other paper type category, that is, plain paper (76 to 90 g/m$^2$); and the value of 100×n1/(n1+n2), which is the ratio of the number of times of detection n1 of plain paper (61 to 75 g/m$^2$), exceeds 90%.

FIGS. 11A and 11B are other diagrams for describing operation of the image forming apparatus described in FIG. 10, which are to be compared with FIG. 5A. As shown in FIG. 11A, a table Tf for a high-speed detection mode which is the same as that in the first embodiment is used as an initial table Tf in the image forming apparatus.

When the value (%) of 100×n1/(n1+n2) exceeds the threshold value (for example, 90%), the control device 51 creates a corrected table Tf1 by rewriting the initial table Tf such that image forming conditions (165° C. and 1800 V) corresponding to one of paper type categories shown in the initial table Tf, which includes a paper type category (here, plain paper (61 to 75 g/m$^2$)) detected in the high-precision detection mode, are changed to image forming conditions (160° C. and 1750 V) shown in the table Ts for the high-precision detection mode.

Other configurations and operations are the same as those in the first embodiment. Thus, description thereof will not be repeated. In the fourth embodiment, image forming conditions for paper sheets P with a high frequency of use in the high-precision detection mode are used to correct image forming conditions of a corresponding paper type category in the table Tf for the high-speed detection mode (table Tf for a manual setting mode). Thus, it is possible to obtain a satisfactory image even when a user selects the high-speed detection mode (or the manual setting mode).

Fifth Embodiment

Described above in the first to fourth embodiments are the cases where two automatic detection modes (high-speed detection mode and high-precision detection mode) are provided as modes for automatically detecting paper types. Meanwhile, it is also possible to provide three or more automatic detection modes. Described below in a fifth embodiment is the case of providing three automatic detection modes (maximum speed detection mode, high-speed detection mode, and high-precision detection mode).

FIGS. 12A and 12B are diagrams showing some of tables to be used in an image forming apparatus according to the fifth embodiment of the present invention. In particular, FIG. 12A shows a table Th for the maximum speed detection mode, and FIG. 12B shows a table Tf for the high-speed detection mode (table Tf for a manual setting mode). The table Tf for the high-speed detection mode (table Tf for the manual setting mode) is as shown in FIG. 5A. A table Ts for the high-precision detection mode is as shown in FIG. 5B. The tables Th, Tf, and Ts are stored in a storage part 51*b*.

Listed in the table Th for the maximum speed detection mode, shown in FIG. 12A, are five paper types (names and basis weight ranges) and five sets of image forming conditions (processing speed, fixing temperature, and transfer voltage) corresponding to the five paper types. That is, the names of the five paper types (thin paper, plain paper, and thick paper A to thick paper C) are listed in the first column (leftmost column) of the table Th. Five paper type categories, that is, the ranges (51 to 60, 61 to 95, . . . , and 231 to 300) of basis weight (g/m$^2$) are listed in the second column of the table Th.

Two processing speeds (mm/s) (200 and 100) are listed in the third column of the table Th. Five fixing temperatures (° C.) (145, 165, 145, 155, and 165) are listed in the fourth column of the table Th. Five transfer voltages (V) (1500, 1800, 1600, 2000, and 2400) are listed in the fifth column of the table Th.

According to the table Th, as the basis weight (g/m$^2$) of a paper sheet P increases, the processing speed (mm/s) is decreased, the fixing temperature (° C.) is increased, and the transfer voltage (V) is increased. This is because, as the basis weight (g/m$^2$) of the paper sheet P increases, the paper sheet P becomes thick, so that a larger amount of heat and a larger electric field are required for surely transferring and fixing a toner image onto the paper sheet P.

When a user selects the maximum speed detection mode by using an operation panel 50, a controller 51*a* controls a conveying motor 28 to cause the paper sheet P to be conveyed at a maximum speed Vh. In addition, the controller 51*a* detects the basis weight (g/m$^2$) of the paper sheet P based on an output signal φ 40 from a basis weight detector 40. Based on the basis weight (g/m$^2$) and the table Th for the maximum speed detection mode, the controller 51*a* selects one of the five paper type categories, and selects image forming conditions corresponding to the paper type category.

For example, when the basis weight of the paper sheet P is 80 g/m$^2$, it is determined that the paper sheet P is categorized as plain paper (61 to 95 g/m$^2$) listed in the second row of the table Th. Thus, image forming conditions (200 mm/s, 165° C., and 1800 V) corresponding thereto are selected. Then, the controller 51*a* controls the printing part 10 under the selected image forming conditions, to print the toner image on the paper sheet P. Furthermore, the controller 51*a* stores the selected paper type in the storage part 51*b*, and causes the operation panel 50 to display the paper type stored in the storage part 51*b* at the time of notification.

The conveyance speed Vh of the paper sheet P in the maximum speed detection mode is set to a speed higher than a conveyance speed Vf of the paper sheet P in the high-speed detection mode (and the manual setting mode) and a conveyance speed Vs of the paper sheet P in the high-precision detection mode (Vh>Vf>Vs). The conveyance speeds Vh, Vf, and Vs may be higher or lower than the processing speeds in image formation. As compared with the other modes, the speed of detection increases, but accuracy in detection decreases in the maximum speed detection mode.

Other configurations and operations are the same as those in the first embodiment. Thus, description thereof will not be repeated. In the fifth embodiment, it is possible to increase the speed of detection of a paper type by selecting the maximum speed detection mode.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a printing part including:

an image carrier on a surface of which an electrostatic latent image is to be formed;

a developing device that develops the electrostatic latent image to generate a toner image;

a transfer device that transfers the toner image on the image carrier to a paper sheet at a transfer position;

a fixing device that fixes the toner image transferred by the transfer device, on the paper sheet; and a cleaner that removes toner remaining on the image carrier;

a selection part that allows a user to select one of a plurality of automatic detection modes of different detection speeds;

a paper conveying part including:

a paper feeder that supplies the paper sheet;

a conveying roller that conveys the paper sheet supplied from the paper feeder at a conveyance speed corresponding to a detection speed in the automatic detection mode selected with the selection part; and a timing roller that supplies the paper sheet conveyed by the conveying roller, to the transfer position;

a detector that detects a characteristic of the paper sheet being conveyed by the conveying roller; and a hardware processor that detects a paper type category to which the paper sheet belongs based on the automatic detection mode selected with the selection part and a result of detection by the detector, and controls the printing part under image forming conditions corresponding to the detected paper type category, to print the toner image on the paper sheet.

2. The image forming apparatus according to claim 1, wherein the hardware processor stores a plurality of tables provided to correspond to the plurality of automatic detection modes, a plurality of paper type categories and a plurality of image forming conditions corresponding to the plurality of paper type categories are listed in each of the tables, and the hardware processor selects a table corresponding to the automatic detection mode selected with the selection part, from among the plurality of tables stored in the hardware processor, selects one of the plurality of paper type categories listed in the selected table, based on the result of detection by the detector, and controls the printing part under image forming conditions corresponding to the selected paper type category.

3. The image forming apparatus according to claim 2, wherein the plurality of automatic detection modes includes first and second automatic detection modes, the plurality of tables includes first and second tables corresponding to the first and second automatic detection modes, respectively, a detection speed in the first automatic detection mode is lower than a detection speed in the second automatic detection mode, first to N-th paper type categories are provided in the first table, and first to M-th paper type categories are provided in the second table, and each of N and M is an integer equal to or larger than 2, N being larger than M.

4. The image forming apparatus according to claim 3, wherein the detector detects a basis weight of the paper sheet as the characteristic of the paper sheet, a specific basis weight range is assigned in advance to each paper type category, basis weights of the first to N-th paper type categories gradually increase, basis weights of the first to M-th paper type categories gradually increase, and the hardware processor selects one of the first to N-th paper type categories based on the basis weight of the paper sheet detected by the detector and the first table in the first automatic detection mode, and selects one of the first to M-th paper type categories based on the basis weight of the paper sheet detected by the detector and the second table in the second automatic detection mode.

5. The image forming apparatus according to claim 4, wherein the first to N-th paper type categories are set by dividing each of the first to M-th paper type categories into a plurality of paper type categories.

6. The image forming apparatus according to claim 4, wherein the first to N-th paper type categories are set by adding a paper type category to at least each boundary between two adjacent paper type categories of the first to M-th paper type categories.

7. The image forming apparatus according to claim 4, wherein the first to N-th paper type categories are set by dividing each of the first paper type category to an m-th paper type category out of the first to M-th paper type categories into a plurality of paper type categories, and m is an integer larger than 1 and smaller than M.

8. The image forming apparatus according to claim 4, wherein the image forming conditions include a processing speed at which the printing part prints the toner image on the paper sheet, a processing speed corresponding to the m-th paper type category is lower than a processing speed corresponding to an (m−1)th paper type category, among the first to M-th paper type categories, the first to N-th paper type categories are set by dividing each of the (m−1)th and m-th paper type categories out of the first to M-th paper type categories into a plurality of paper type categories, and m is an integer larger than 2 and smaller than M.

9. The image forming apparatus according to claim 4, wherein the m-th paper type category among the first to M-th paper type categories includes n-th and (n+1)th paper type categories out of the first to N-th paper type categories, m being an integer from 1 to M, n being an integer from 1 to (N−1), and when a ratio of a number of times one of the n-th and (n+1)th paper type categories is selected, to a sum of numbers of times the n-th and (n+1)th paper type categories are selected exceeds a predetermined threshold value, the hardware processor rewrites image forming conditions corresponding to the m-th paper type category in the second table such that the image forming conditions corresponding to the m-th paper type category are changed to image forming conditions corresponding to the one of the n-th and (n+1)th paper type categories.

10. The image forming apparatus according to claim 4, further comprising a setting part that allows the user to set a paper type category of the paper sheet, wherein when a paper type of the paper sheet is set with the setting part, the conveying roller conveys the paper sheet at a speed intended for a case where the second automatic detection mode is selected, and when the paper type category of the paper sheet is set with the setting part, the hardware processor refers to the second table to control the printing part under image forming conditions corresponding to the set paper type category.

11. The image forming apparatus according to claim 4, further comprising a notification part that notifies the user of the paper type category selected by the hardware processor.

12. The image forming apparatus according to claim 11, wherein the first to N-th paper type categories are set by dividing each of the first to M-th paper type categories into a plurality of paper type categories, and the notification part notifies the paper type category selected from among the first to M-th paper type categories in the second automatic detection mode, and notifies one of the first to M-th paper type categories corresponding to the paper type category selected from among the first to N-th paper type categories in the first automatic detection mode.

13. The image forming apparatus according to claim 4, wherein the detector includes:

a light emitting element that emits light to the paper sheet;

a light receiving element that detects an intensity of light emitted from the light emitting element and having passed through the paper sheet; and a calculator that calculates the basis weight of the paper sheet based on an intensity of the light emitted from the light emitting element and the intensity of the light detected by the light receiving element.

14. The image forming apparatus according to claim 13, wherein the hardware processor increases an intensity of light to be emitted from the light emitting element as the detection speed in the automatic detection mode selected with the selection part increases.

15. The image forming apparatus according to claim 1, wherein the image forming conditions include a processing speed at which the printing part prints the toner image on the paper sheet.

16. The image forming apparatus according to claim 1, wherein the image forming conditions include a temperature at which the fixing device fixes the toner image on the paper sheet.

17. The image forming apparatus according to claim 1, wherein the image forming conditions include a voltage at which the transfer device transfers the toner image to the paper sheet.

* * * * *